US008154466B2

(12) United States Patent
Lewis et al.

(10) Patent No.: US 8,154,466 B2
(45) Date of Patent: Apr. 10, 2012

(54) ANTENNA FEED MODULE

(75) Inventors: Gareth Michael Lewis, Chelmsford (GB); Gary David Panaghiston, Chelmsford (GB); Larry Brian Tween, Chelmsford (GB); Richard John Harper, Chelmsford (GB)

(73) Assignee: BAE SYSYTEMS plc, London (GB)

( * ) Notice: Subject to any disclaimer, the term of this patent is extended or adjusted under 35 U.S.C. 154(b) by 0 days.

(21) Appl. No.: 12/375,338

(22) PCT Filed: Dec. 17, 2008

(86) PCT No.: PCT/GB2008/051196

§ 371 (c)(1),
(2), (4) Date: Mar. 25, 2009

(87) PCT Pub. No.: WO2009/077791

PCT Pub. Date: Jun. 25, 2009

(65) Prior Publication Data

US 2010/0245202 A1 Sep. 30, 2010

(30) Foreign Application Priority Data

Dec. 18, 2007 (GB) ..... 0724684.6

(51) Int. Cl.
*H01Q 21/00* (2006.01)

(52) U.S. Cl. ..... 343/816; 343/814; 343/820; 343/821

(58) Field of Classification Search ..... 343/810, 343/814, 816, 820, 821, 853, 859, 700 MS; 333/26; 342/372, 373

See application file for complete search history.

(56) References Cited

U.S. PATENT DOCUMENTS

| | | | | |
|---|---|---|---|---|
| 3,750,185 | A | 7/1973 | Evans | |
| 3,887,925 | A * | 6/1975 | Ranghelli et al. | 343/795 |
| 6,104,343 | A | 8/2000 | Brookner et al. | |
| 6,188,361 | B1 | 2/2001 | George et al. | |
| 6,229,498 | B1 * | 5/2001 | Matsuyoshi et al. | 343/895 |

(Continued)

FOREIGN PATENT DOCUMENTS

| | | | |
|---|---|---|---|
| GB | 2 303 740 | A | 2/1997 |
| GB | 2 316 233 | A * | 2/1998 |
| JP | 2004-023243 | A | 1/2004 |

OTHER PUBLICATIONS

Nēsić A. et al., "New Printed Antenna with Circular Polarization", Proceedings of the 26th European Microwave Conference 1996, Prague, Sep. 9-13, 1996; [Proceedings of the European Microwave Conference], Swanley, Nexus Media, GB, vol. Conf. 26, pp. 569-573, XP000682599.

(Continued)

*Primary Examiner* — Hoang V Nguyen
(74) *Attorney, Agent, or Firm* — Scully, Scott, Murphy & Presser, P.C.

(57) ABSTRACT

A feed module is provided for an array antenna. The feed module comprises a multi-layer printed circuit board (PCB) feed structure for coupling signals between connections to transmitters or receivers and connection points for connecting to antenna elements of the array antenna. The multi-layer PCB feed structure comprises a body portion, incorporating coupling components, and a number of line sections for connecting to elements of the array antenna. The planar layers of the multi-layer PCB are arranged to be mounted substantially perpendicular to a planar array of antenna elements of the array antenna when the feed module is integrated therewith.

12 Claims, 8 Drawing Sheets

U.S. PATENT DOCUMENTS

| | | | | |
|---|---|---|---|---|
| 6,429,816 | B1 | 8/2002 | Whybrew et al. | |
| 7,372,424 | B2 * | 5/2008 | Mohuchy et al. | 343/795 |
| 7,408,525 | B2 * | 8/2008 | Webb et al. | 343/866 |
| 2004/0017266 | A1 | 1/2004 | Zhao et al. | |

OTHER PUBLICATIONS

International Search Report dated Apr. 9, 2009.
International Preliminary Examination Report and Written Opinion, dated Jun. 22, 2010.

* cited by examiner

ANTENNA FEED MODULE

This invention relates to antenna feeds, in particular but not exclusively to an antenna feed module for a high density phased array antenna.

One of the problems encountered in designing and building a high density phased array antenna for use in the 2-20 GHz frequency range, for example, lies in physically accommodating the required interfacing at the feed side of the array. In particular, a way needs to be found to accommodate connectors that are generally required to feed all the antenna elements. For some preferred antenna arrays, known feed arrangements may not be sufficiently compact.

From a first aspect the present invention resides in a feed module for an array antenna, comprising:

a multi-layer printed circuit board (PCB) feed structure for coupling signals between a plurality of first connection points to the module and a plurality of second connection points to the module for connecting to respective elements of an array antenna, wherein the multi-layer PCB feed structure comprises a body portion, incorporating coupling components, and a plurality of line sections for connecting to elements of the array antenna, wherein planar layers of the multi-layer PCB are arranged to be mounted substantially perpendicular to a planar array of antenna elements of the array antenna when the feed module is integrated therewith.

A multi-layer PCB provides a particularly convenient structure in which to provide coupling components for feeding a number of antenna elements arranged, preferably, in a row. Assembly of an array antenna using feed modules according to this first aspect of the present invention is particularly simple in comparison with conventional techniques. When integrated with an array antenna, the elements of the array are fed by a plurality of the feed modules arranged substantially in parallel.

Preferably, the coupling components comprise a plurality of balun couplers for providing a balanced feed to respective pairs of dipole elements of the array antenna. Integration of balanced couplers within the feed modules significantly simplifies the external circuitry required to feed the antenna. A preferred implementation of the coupling components makes use of Marchand balun couplers implemented using stripline conductors within the body portion of the multi-layer PCB feed structure. Alternatively, tapered baluns may be implemented within the body portion of the feed structure using microstrip, going to stripline to link with the antenna elements. The stripline conductors in particular may be arranged over a plurality of layers of the multi-layer PCB and, where interconnection is required between stripline conductors in different layers, this is by means of vias.

In a preferred stripline implementation, each of the plurality of line sections comprise at least one stripline transmission line for connecting to an element of the array antenna. Preferably, the stripline conductor of the at least one stripline transmission line is connected to a connecting pad formed on the edge of the multi-layer PCB where the stripline conductor terminates. This makes connection of the stripline transmission line conductor to a respective element of the array antenna particularly simple, using a solder joint or a wire connection.

According to a preferred embodiment of the present invention, the feed module may further comprise components of a transmitter or receiver within the body portion of the feed module. This further simplifies the external circuitry required to feed an array antenna.

From a second aspect the present invention resides in an array antenna in which antenna elements of the array are fed by means of a plurality of feed modules according to the first aspect of the present invention. More particularly, the array antenna according to this second aspect comprises a substantially planar array of antenna elements mounted substantially parallel to a conducting ground plane layer and separated therefrom by an intermediate layer of dielectric material, wherein the conducting ground plane layer is provided with holes through which line sections of the plurality of feed modules may pass, and wherein on passing through the conducting ground plane layer the line sections extend through the intermediate layer to the planar array of antenna elements for connection thereto.

From a third aspect, the present invention resides in an array antenna, comprising an integrated multi-layer PCB feed module mounted substantially perpendicular to a planar array of antenna elements and providing interfacing components operable to provide a balanced feed to respective pairs of said antenna elements.

Preferred embodiments of the present invention will now be described in more detail, by way of example only, and with reference to the accompanying drawings of which:

FIG. 1 provides a perspective view of the exterior of a feed module according to preferred embodiments of the present invention;

FIG. 2 provides a perspective view revealing the structure of a portion of an array antenna incorporating a feed module according to preferred embodiments of the present invention;

FIGS. 3*a* and 3*b* show two preferred arrangements for an antenna element connected to a feed module in preferred embodiments of the present invention;

An antenna feed module according to a preferred embodiment of the present invention will now be described with reference to FIGS. 1 to 4.

Figure 1:
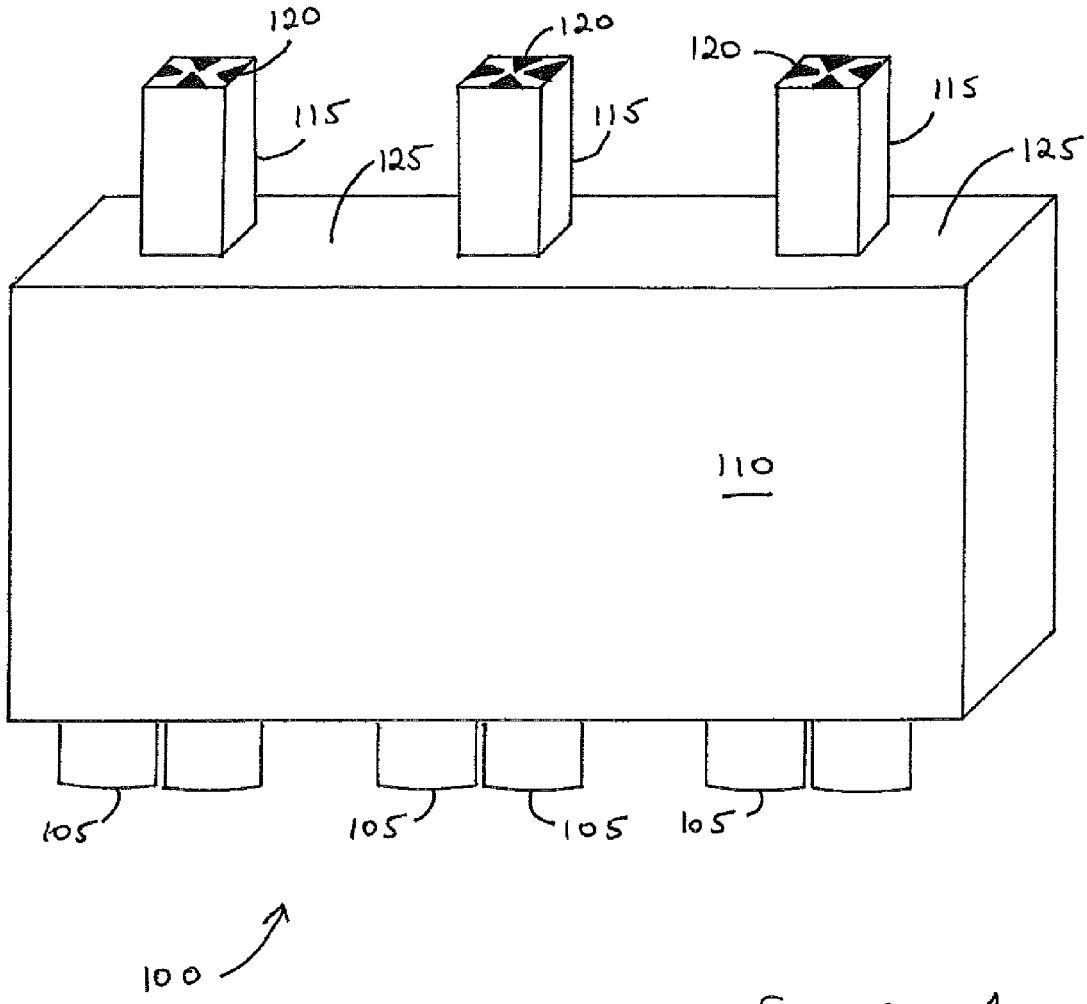

Referring firstly to FIG. 1, a diagram is provided showing the exterior structure of a portion of an antenna feed module 100, shown prior to assembly into an antenna array. The portion 100 shown in FIG. 1 is arranged to feed a row of only three antenna elements whereas in practice a feed module 100 would be of sufficient length to feed a row comprising a greater number of antenna elements, convenient numbers being ten or sixteen for example. An antenna element for the purposes of the present patent specification will be assumed to comprise a planar group of differently oriented dipole elements, for example four dipole elements formed into a cross arrangement. Alternative configurations and numbers of dipole elements are also possible within the definition of an antenna element. For example, an antenna element may comprise a group of only two dipole elements arranged linearly.

Preferably, the antenna elements of a phased array antenna to which the feed module 100 may be applied are arranged in rows so that the feed modules for feeding each row of antenna elements may be placed parallel and side-by-side.

Connection of the feed module 100 to separate transmitter or receiver circuits in respect of each antenna element is by means of connectors 105. However, in a preferred embodiment of the present invention, transmitter and/or receiver circuitry may be integrated within the antenna feed module 100 itself and a different type of connector 105 may then be appropriate.

The feed module 100 comprises a multi-layer printed circuit board (PCB) having a main body section 110 containing coupling elements and any other components, passive or active, that may advantageously be integrated into the feed module 100, and a number of evenly spaced extended sections in the form of pillars 115, one pillar 115 for each antenna element in the antenna array. Each pillar 115 contains stripline transmission line conductors for connection to each of the dipole elements of an antenna element, for example an antenna element comprising four dipole elements. The outer layers of the multi-layer PCB are of copper to provide the ground plane layers to the stripline conductors within the PCB. Between and beside the pillars 115 the main body section 110 provides a planar shoulder surface 125.

The body portion 110 of the feed module 100 shown in FIG. 1 is provided with an additional dielectric layer on each face of the multi-layer PCB, to increase the width of the body portion 110 of the feed module 100 to substantially that of the antenna elements that the feed module 100 is designed to feed. This enables adjacent feed modules 100 to be mounted without gaps between them and so create a more robust antenna structure. The thickness of the multi-layer PCB is substantially the same throughout the feed module 100 and is equal to the thickness of the pillar 115 in the preferred embodiment shown in FIG. 1.

The impedance of each stripline within a pillar 115 is determined by the antenna reference impedance, but is typically 50 to 75 Ohms. Each stripline conductor, where it becomes accessible at the end of the respective pillar 115, is edge-connected to a small connecting pad 120, formed preferably by copper plating the end of the pillar 115 and removing copper to leave four separate connecting pads 120. The connecting pads 120 enable easy and effective connection to respective dipole elements of an antenna element, as will be explained below. When integrated with a planar array of antenna elements, the circuit board layers in the feed module 100 are disposed substantially perpendicular to the plane of the antenna elements, providing for a particularly convenient implementation.

There are numerous types of connector 105 and methods of connection of the feed module 100 to external circuitry, as would be apparent to a person of ordinary skill in this field. Whereas standard connecting sockets take up a significant amount of space which can be prohibitive when feeding a high-density phased array antenna, the feed module 100 of the present invention, as will be described below, enables the number of separate connectors 105 required to connect to an antenna element of four dipole elements to be limited to two. The connectors 105 may be arranged in a line on the feed module or, if space is more limited, in a staggered arrangement.

Before describing the multi-layer PCB structure of the feed module 100 in detail, a preferred arrangement of the feed module 100 integrated with a portion of a planar array of antenna elements will now be described with reference to FIG. 2.

Figure 2:
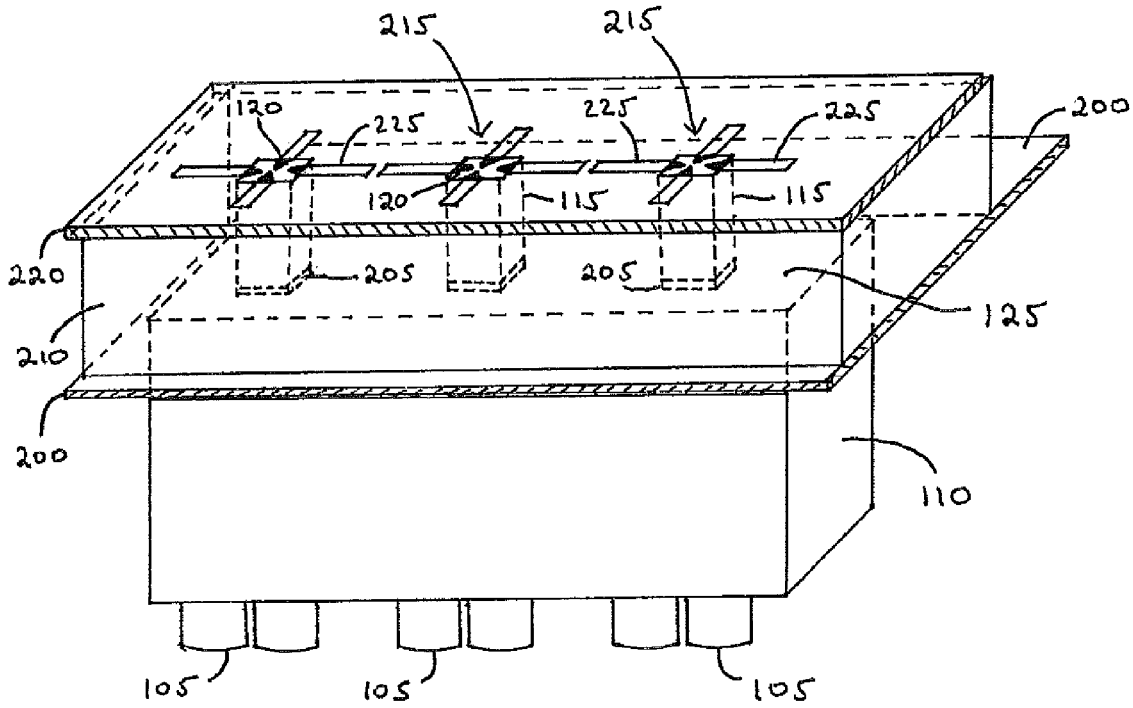

Referring to FIG. 2, a diagram is provided to show how the feed module 100 may be integrated with key components of a high density phased array antenna. A conducting ground plane layer 200 is provided with holes 205 spaced according to the separation of the pillars 115 of the feed module 100 so that the pillars 115 may pass through the holes 205 in the ground plane layer 200 in order to feed antenna elements 215 of the array. The ground plane layer 200 is bonded to the shoulder surface 125 between and beside the pillars 115, preferably using a conducting silver epoxy. Preferably, the shoulder surface 125 and the walls of each pillar 115, up to a level just short of the end of the pillar 115, are plated with copper. The silver epoxy ensures that the conducting ground plane 200 is electrically connected to the copper plated walls of the pillars 115. A layer 210 of dielectric foam, preferably from the Rohacell® range of hard dielectric foam materials, is placed over the ground plane layer 200 to a depth sufficient to leave a small unplated portion of each pillar 115 protruding above the surface of the foam layer 210. Suitably positioned holes formed in the foam layer 210 accommodate the pillars 115.

A planar array 220 of antenna elements 215 is sandwiched between two thin layers of liquid crystalline polymer (LCP), for example from the Ultralam® range of LCP products supplied by Rogers Corporation. Preferably, the dipole elements are formed by removal of excess copper from a layer of copper plate applied to one layer of the LCP material to leave a pattern of antenna elements 215 over its surface, and second layer of LCP material is then bonded to the patterned layer to create the sandwiched array 220. Preferably, for a dual polarised array antenna, each antenna element 215 comprises four dipole elements 225 arranged in the shape of a cross. The four dipole elements 225 are arranged such that when a hole is machined through the lower layer of the LCP of the same size as the end of a pillar 115, the dipoles 225 are arranged around the perimeter of the hole and an end of each dipole element is exposed to enable a connection to be made. The sandwiched array 220 is overlaid and bonded onto the foam layer 210 and the small protruding section of each pillar 115 engages with a hole in the sandwiched array 220. The portion of each dipole element 225 overlapping into the hole is positioned directly above a respective connecting pad 120 on the end of a pillar 115 so that a soldered connection may be made. This aspect is shown in more detail in FIG. 3 in two preferred arrangements.

Figure 3A:
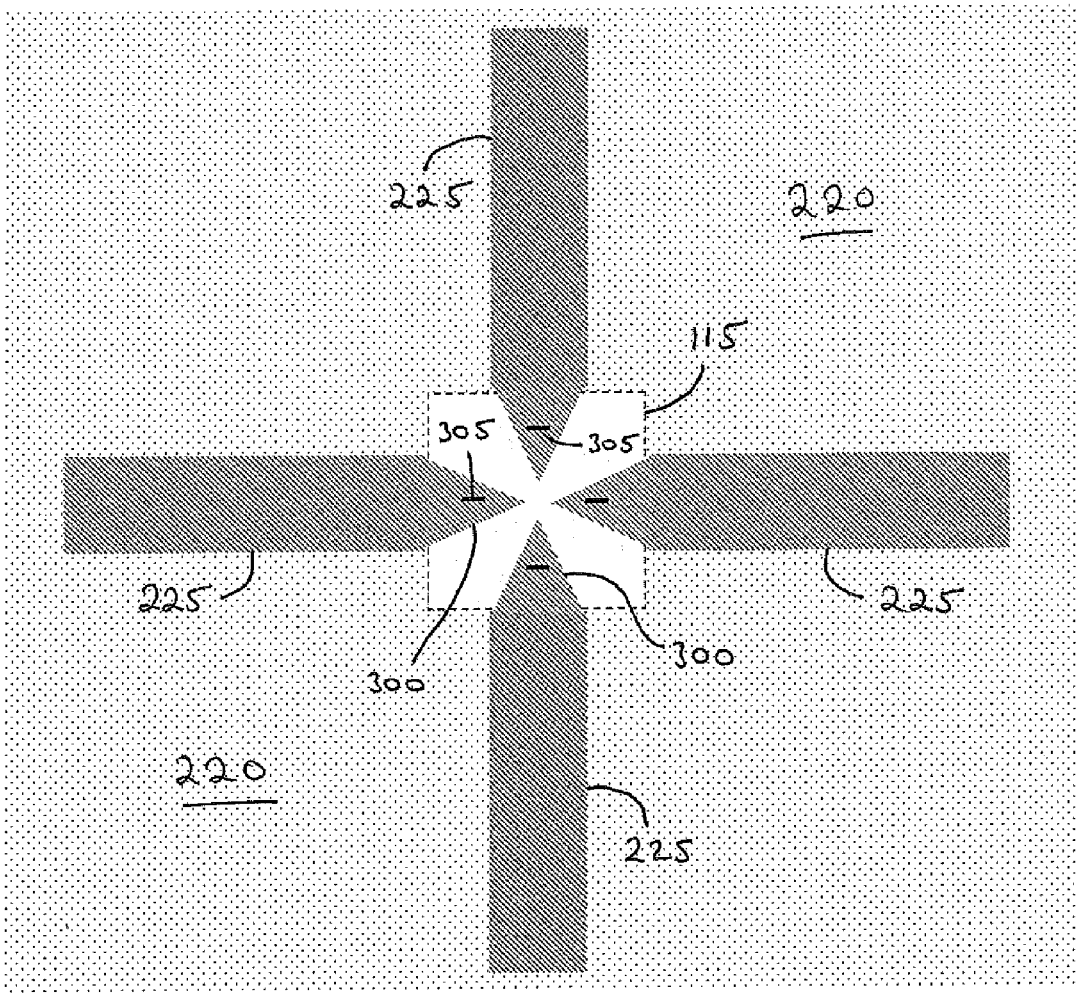

Referring firstly to FIG. 3*a*, a view is provided of a single antenna element 215 within a sandwiched array 220 of such elements mounted in an assembled array antenna. The antenna element 215 is shown comprising four dipole elements 225 in the form of a cross arranged around the perimeter of a hole formed in the lower layer of LCP of the sandwiched array 220 accommodating the end of a pillar 115. Each of the dipole elements 225 is provided with a section 300 which extends into the hole and overlaps, and is of the same shape as, a respective connecting pad 120 (not shown in FIG. 3*a*) on the end of the pillar 115 so that a soldered electrical connection can be made between them (preferably by the application of heat through the upper layer of LCP of the sandwiched array 220). The positions of the stripline conductors 305 emerging from the feed module 100, accessible at the end of the pillar 115 and electrically connected to the respective connecting pads 120, are shown in FIG. 3*a*.

Figure 3B:
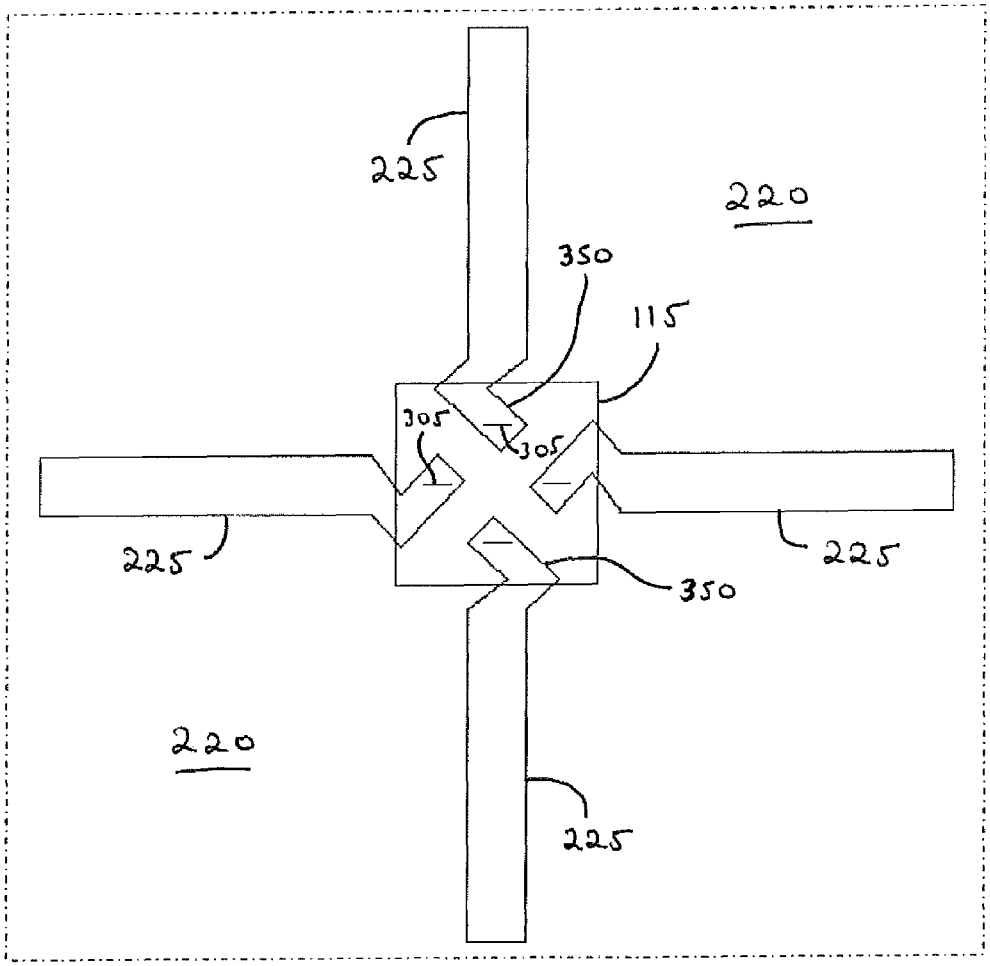

Referring now to FIG. 3*b*, an improved arrangement is shown for an antenna element 215. In this preferred arrangement, each of the dipole elements 225 is provided with a "dog-leg" section of stripline conductor 350 which extends into the hole and overlaps a respective connecting pad of the same shape (not shown in FIG. 3*b*) on the end of the pillar 115. As for the first arrangement, a soldered electrical connect can be made between the dog-leg section 350 and the connecting pad below, preferably by the application of heat through the upper layer of LCP of the sandwiched array 220. The principal advantage of this preferred arrangement is that the dog-leg section of stripline 350 of each dipole element 225 is positioned and oriented so that it is oriented at 45° to the respective stripline conductor 305 in the pillar 115 to which it connects, providing a symmetric arrangement of interconnections for all four dipole elements 225 and hence a more balanced signal transfer from the feed module 100.

In a phased array antenna incorporating feed modules 100 according to the present invention, the antenna elements 215 and hence the feed modules 100 are arranged in rows with each feed module 100 interfacing to antenna elements 215 in one row or part of a row. Assembly of the antenna is therefore particularly simple once the feed modules 100 have been made.

Figure 4:
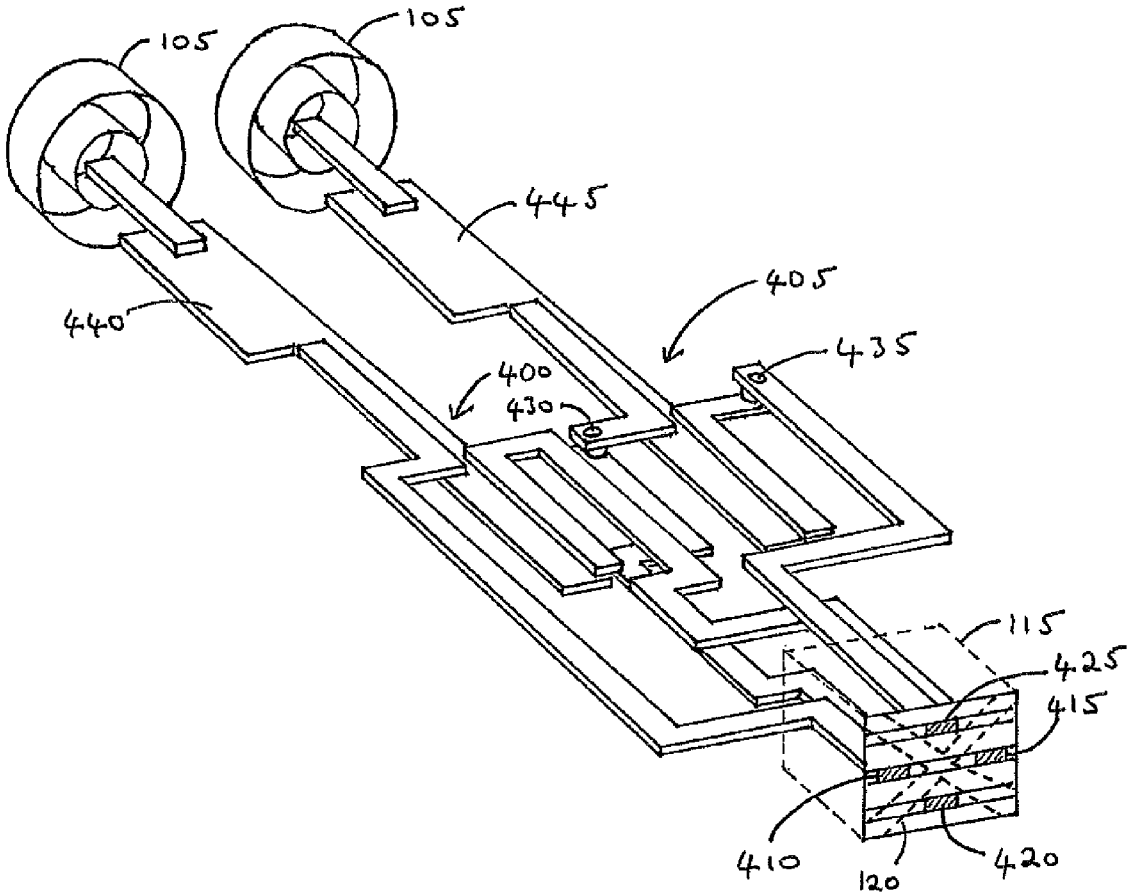
FIG. 4 shows a preferred layout for a stripline implementation of a pair of Marchand balun couplers within the feed module according to a preferred embodiment of the present invention.
Figure 5:
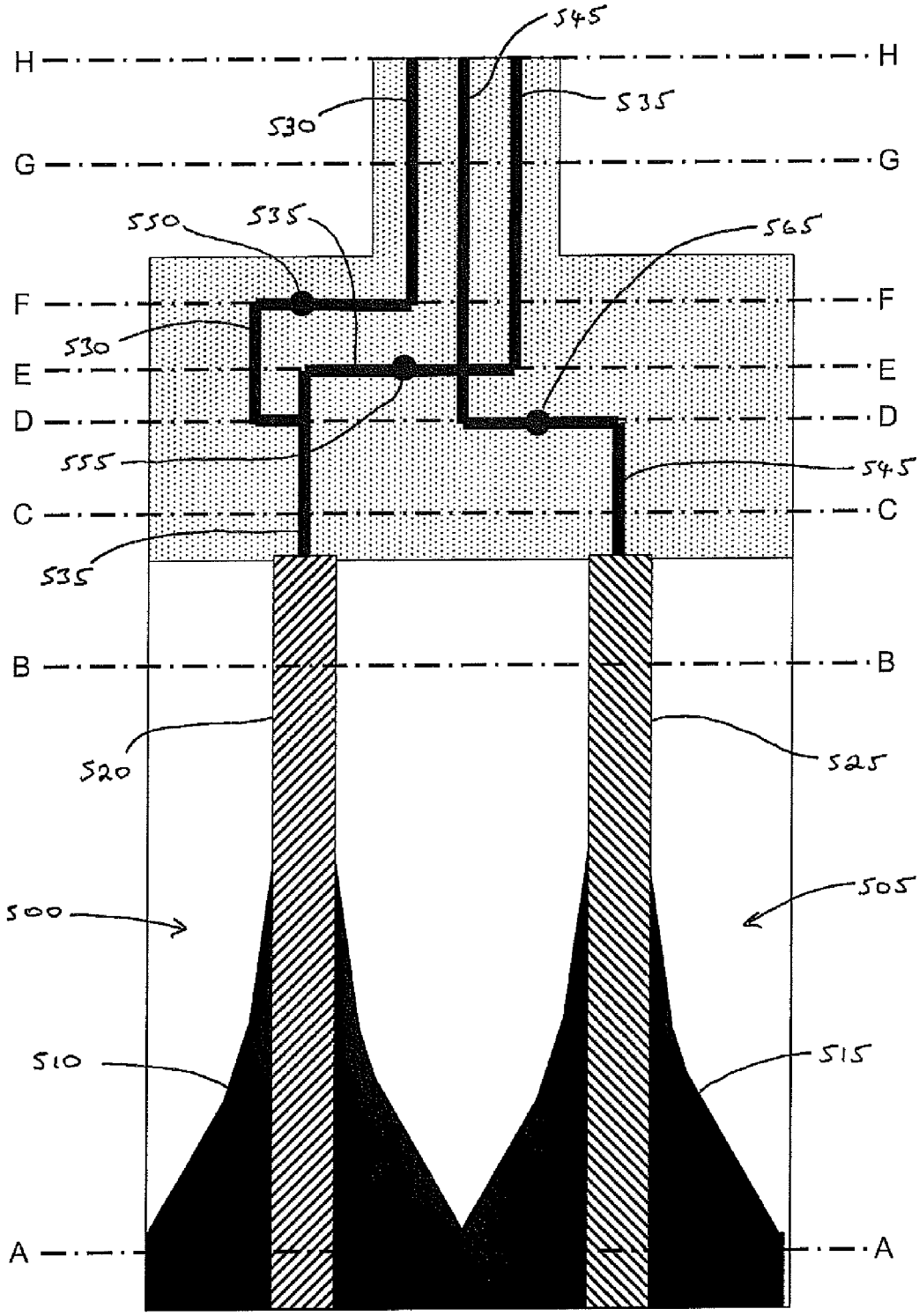
FIG. 5 shows in a plan view an alternative design of balun for use in the feed module according to a preferred embodiment of the present invention.

Details of two preferred layered structures for the feed module 100 will now be provided, according to preferred embodiments of the present invention, the first with reference to FIG. 4 and the second with reference to FIG. 5 and FIG. 6. In each example, in order for the feed module 100 to provide a balanced feed to respective pairs of dipole elements 225 in an antenna element 215, a pair of balanced couplers is provided in the main body section 110 of the feed module 100. In the first preferred structure, a stripline implementation of a pair of Marchand baluns has been used. In the second, an arrangement comprising a pair of tapered baluns has been devised. Marchand baluns in particular are known to provide good amplitude and phase balance (180°. Their length (half of one wavelength at the centre frequency of operation) is sufficiently small to be accommodated within a multi-layer PCB feed module 100. The first preferred structure of stripline conductors, based upon a feed module 100 made using an eight layer PCB, will now be described with reference to FIG. 4.

Referring to FIG. 4, a perspective view is provided to show a preferred arrangement of stripline conductors to provide first and second Marchand baluns 400, 405 respectively where the connectors 105 on the feed module 100 are arranged in a line. The first Marchand balun 400 links through an input line section 440 to a connector 105 and at the other to a pair of stripline conductors 410, 415. Where they become accessible at the end of the pillar 115, the stripline conductors 410, 415 may be connected by means of connecting pads 120 (shown in outline in FIG. 4) to a pair of dipole elements 225 of an antenna element 215, in particular a pair of dipole elements 225 forming opposite arms in a crossed form of antenna element 215. The second Marchand balun 405 links through an input line section 445 to a connector 105 and at the other to a pair of stripline conductors 420, 425 for connection to the other opposed pair of dipole elements 225 of the antenna element 215. The lengths of stripline conductor between the baluns 400, 405 and the respective connecting pads 120 are equalised so as to avoid unwanted phase differences when feeding a given antenna element 215.

Each of the Marchand baluns 400, 405 comprise sections of stripline conductor in different layers within the PCB structure 110. Stripline conductors in different layers may be linked together using vias 430, 435. Of course, alternative arrangements of stripline conductors may be used to implement the baluns 400, 405, in particular if a staggered arrangement of connectors 105 is provided on the feed module 100 such that the input line sections 440, 445 to the baluns 400, 405 lie in different layers of the multi-layer PCB 110. The design of alternative arrangements of stripline conductors would be well within the capabilities of a person of ordinary skill in this field given the information provided above.

A second preferred structure for a feed module 100 based upon a tapered form of balun will now be described with reference to FIG. 5 and FIG. 6. This second preferred structure is potentially simpler than that required to accommodate the Marchand baluns as described above, but is based upon the same eight layer PCB.

Referring initially to FIG. 5, a plan view is provided of a second preferred structure for a feed module 100 comprising first and second tapered baluns 500, 505. Referring additionally to FIG. 6, a series of sectional views are provided in FIGS. 6A to 6H through the feed module of FIG. 5 at each of the positions A to H respectively as designated in FIG. 5, each view being along the direction of travel of signals from A to H.

Figure 6A:
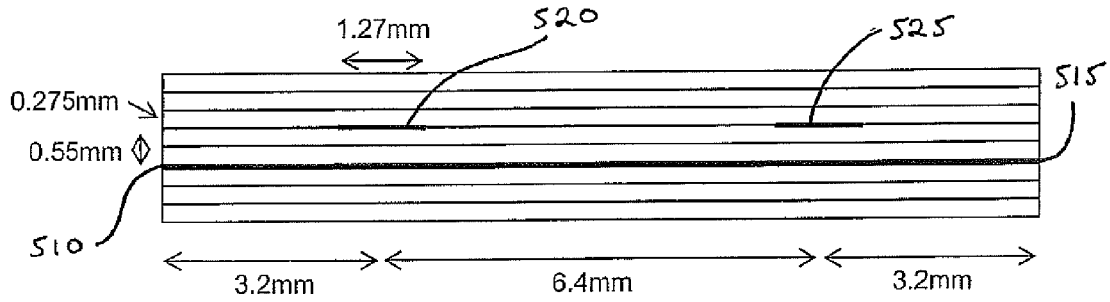
FIGS. 6A-6H show sectional views through the alternative design of balun in FIG. 5.

The first and second tapered baluns 500, 505 each comprise, respectively, tapered conductors 510, 515 implemented preferably as microstrip conductors disposed parallel to and separated from microstrip conductors 520, 525 of constant width, wherein the tapered conductors 510, 515 are formed in one layer of the multi-layer PCB and the constant width conductors 520, 525 are formed in a different parallel layer of the PCB. This arrangement is shown in FIG. 6A in a sectional view through the plane designated A-A in FIG. 5. Connectors (not shown in FIG. 5) attach to the broadest end of each tapered conductor 510, 515 and the respective constant width conductor 520, 525 in a similar arrangement to that for the connectors 105 of FIG. 4.

Figure 6B:
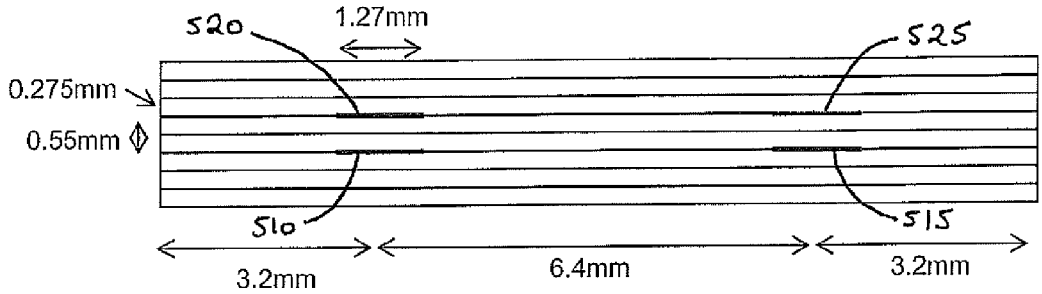
Figure 6C:
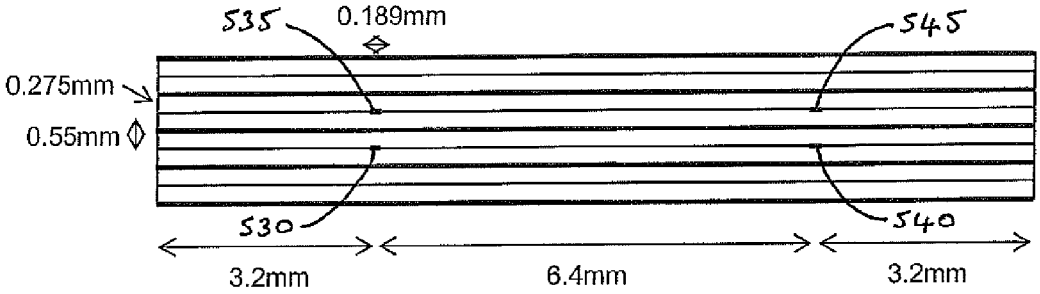
Figure 6D:
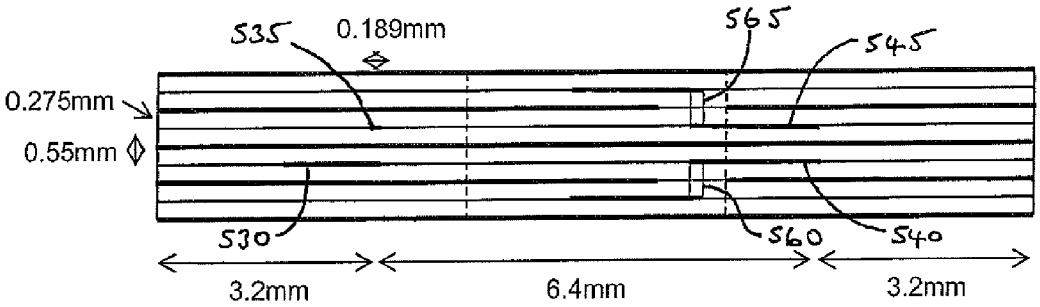
Figure 6E:
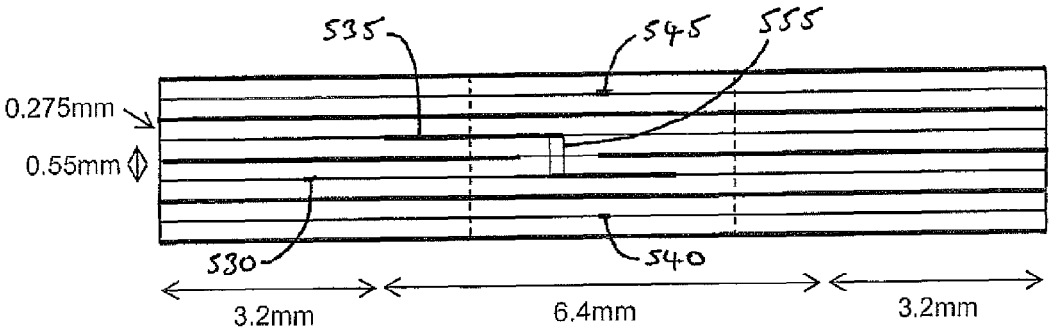
Figure 6F:
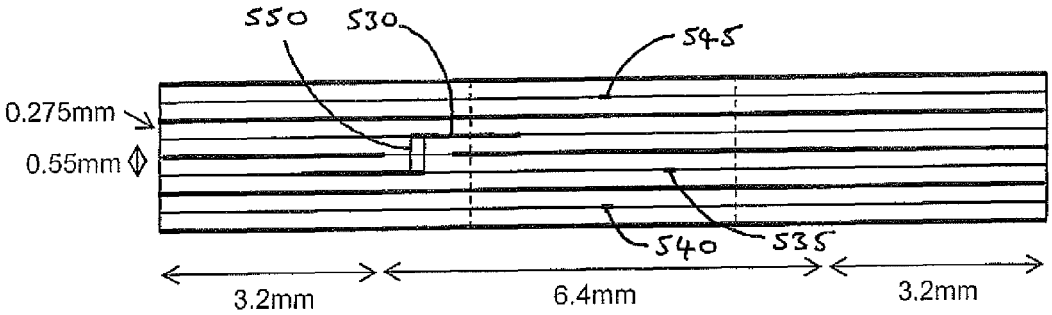
Figure 6G:
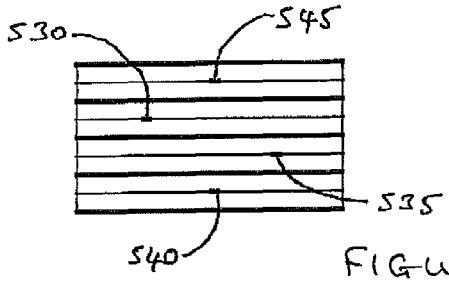
Figure 6H:
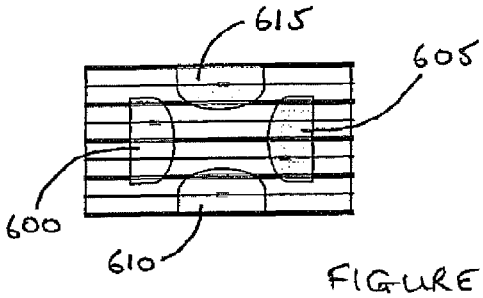

The tapered conductors 510, 515 taper until they become the same width as the constant width conductors 520, 525. The parallel conductor pairs 510, 520 and 515, 525 extend thereafter for a predetermined distance with equal width, the predetermined distance being sufficient to establish a symmetrical field structure. A sectional view through this part of the feed module is shown in FIG. 6B in a sectional view through the plane designated B-B in FIG. 5. The parallel conductor pairs then enter a region of narrow stripline conductors designed to provide conducting paths of equal length linking the balun conductors 510-525 with four respective solder connection pads 600-615, shown in FIG. 6H, which provide connection points for dipole antenna elements. Different sectional views through this part of the feed module are shown in FIGS. 6C to 6G through the planes designated C-C to G-G respectively in FIG. 5.

The conductors 510, 520 of the first balun 500 link to narrow strip conducting paths 530, 535 respectively and the conductors 520, 525 of the second balun 505 link to narrow strip conducting paths 540, 545 respectively. In order to link the balun conductors 510-525 to respective connection pads 600-615, an arrangement of plated vias is required to link different sections of the narrow strip conductors in different layers of the multi-layer PCB. For the first balun 500, the narrow conducting path 530 comprises sections linked between layers by a via 550 and the conducting path 535 is linked between layers by a via 555. Similarly, for the second balun, the conducting path 540 comprises sections linked between layers by a via 560 and the conducting path 545 is linked between layers by a via 565. The narrow stripline conducting paths 530-545 then terminate, as shown in the sectional view in FIG. 6H, with solder connection pads 600-615 respectively.

Two different structures for a feed module have been described above according to preferred embodiments of the present invention. However, the scope of the present invention is intended to include variations on the designs of these structures as would be apparent to a person of ordinary skill in the relevant art, in particular for designs of alternative arrangements of conductors and in multi-layer PCB structures of different numbers of layers designed to achieve balanced feeds within a compact integrated feed module for an array antenna.

The invention claimed is:

1. A feed module for an array antenna, comprising:

a multi-layer printed circuit board (PCB) structure having a body portion and at least one extended portion in the form of a pillar, the body portion of the PCB structure incorporating coupling components and line sections for linking a plurality of first connection points of the feed module to a corresponding plurality of second connection points provided on the at least one extended portion for connecting to respective elements of an array antenna, wherein the coupling components and the line sections are formed within layers of the multi-layer PCB structure and wherein the layers of the multi-layer PCB structure are oriented substantially perpendicular to the elements of the array antenna when the feed module is integrated therewith.

2. The feed module according to claim 1, wherein the multi-layer PCB structure comprises a plurality of said extended portions in linear spacing along the body portion of the feed module and each having a plurality of second connection points such that, the feed module is arranged to feed a row of elements of the array antenna.

3. The feed module according to claim 1, where the coupling components comprise a plurality of balun couplers for providing a balanced feed to respective pairs of elements of the array antenna.

4. The feed module according to claim 3, wherein the balun couplers are tapered balun couplers implemented using a combination of microstrip and stripline conductors within the body portion of the multi-layer PCB structure.

5. The feed module according to claim 3, wherein the balun couplers are Marchand balun couplers implemented using stripline conductors within the body portion of the multi-layer PCB structure.

6. The feed module according to claim 5, wherein the stripline conductors are arranged over a plurality of layers of the multi-layer PCB and wherein interconnection between stripline conductors in different layers is by means of vias.

7. The feed module according to claim 5, wherein each of the plurality of line sections comprise at least one stripline transmission line that extends through the at least one extended portion for connecting to an element of the array antenna.

8. The feed module according to claim 7, wherein the stripline conductor of said at least one stripline transmission line terminates with at least one of the plurality of second connection points comprising a connecting pad formed on an edge of the multi-layer PCB structure that forms a respective extended portion of the feed module.

9. The feed module according to claim 8, wherein the connecting pad is formed in the same shape as the corresponding portion of a dipole element of the array antenna to which it is arranged to connect.

10. The feed module according to claim 1, further comprising components of a transmitter or receiver incorporated within the multi-layer PCB structure of the feed module.

11. An array antenna, comprising a substantially planar array of antenna elements fed by a plurality of feed modules according to claim 1 disposed in a side-by-side arrangement.

12. The array antenna according to claim 11, comprising a substantially planar array of antenna elements mounted substantially parallel to a conducting ground plane layer and separated therefrom by an intermediate layer of dielectric material, wherein the conducting ground plane layer is provided with holes through which the at least one extended portion of each of the plurality of feed modules may pass, and wherein the extended portion of the plurality of feed modules extend through the intermediate layer to the planar array of antenna elements for connection thereto.

* * * * *

UNITED STATES PATENT AND TRADEMARK OFFICE

CERTIFICATE OF CORRECTION

PATENT NO. : 8,154,466 B2
APPLICATION NO. : 12/375338
DATED : April 10, 2012
INVENTOR(S) : Gareth Michael Lewis et al.

It is certified that error appears in the above-identified patent and that said Letters Patent is hereby corrected as shown below:

Title page item (73) Assignee: should read: BAE SYSTEMS plc., London, GB

Signed and Sealed this
Fifth Day of June, 2012

David J. Kappos

David J. Kappos
*Director of the United States Patent and Trademark Office*